US010464222B2

(12) United States Patent
Frauenglass

(10) Patent No.: US 10,464,222 B2
(45) Date of Patent: Nov. 5, 2019

(54) FOUR BAR KNIFE

(71) Applicant: Andrew Frauenglass, Albuquerque, NM (US)

(72) Inventor: Andrew Frauenglass, Albuquerque, NM (US)

( * ) Notice: Subject to any disclaimer, the term of this patent is extended or adjusted under 35 U.S.C. 154(b) by 172 days.

(21) Appl. No.: 15/877,342

(22) Filed: Jan. 22, 2018

(65) Prior Publication Data

US 2018/0169876 A1 Jun. 21, 2018

Related U.S. Application Data

(62) Division of application No. 15/006,253, filed on Jan. 26, 2016, now Pat. No. 9,908,246.

(51) Int. Cl.

| | |
|---|---|
| ***B26B 1/10*** | (2006.01) |
| ***B26B 1/02*** | (2006.01) |
| ***B26B 1/04*** | (2006.01) |
| ***B26B 1/00*** | (2006.01) |

(52) U.S. Cl.

CPC ..... *B26B 1/10* (2013.01); *B26B 1/02* (2013.01); *B26B 1/04* (2013.01)

(58) Field of Classification Search

CPC .... B26B 1/00; B26B 1/02; B26B 1/04; B26B 1/042; B26B 1/046; B26B 1/048; B26B 1/06; B26B 1/08; B26B 1/10

See application file for complete search history.

(56) References Cited

U.S. PATENT DOCUMENTS

| | | | | |
|---|---|---|---|---|
| 5,794,345 | A | 8/1998 | Ryon | |
| 6,898,858 | B1 | 5/2005 | Spell | |
| 7,634,858 | B1 | 12/2009 | Frazer | |
| 2007/0124940 | A1 | 6/2007 | Hawk | |
| 2013/0247382 | A1 | 9/2013 | Hongquan | |
| 2015/0239134 | A1 | 8/2015 | Duey | |
| 2016/0368154 | A1 | 12/2016 | Varner | |
| 2018/0154531 | A1* | 6/2018 | Caswell | B26B 1/00 |
| 2019/0202072 | A1* | 7/2019 | Gariboldi | B26B 1/02 |

* cited by examiner

*Primary Examiner* — Daniel J Colilla

(57) ABSTRACT

A folding knife that uses a four bar linkage mechanism to open and close. The knife can include a means of one hand opening and closing as well as a means to become latched in, and released from, a fixed position. The four bar linkage knife includes a blade, a handle, and the motion of a four bar linkage to open and close the knife. The four bar knife provides inherent safety because the four bar linkage motion can not fold onto the users hand.

4 Claims, 10 Drawing Sheets

24

FOUR BAR KNIFE

BACKGROUND OF THE INVENTION

1. Field of the Invention

This invention relates to a folding knife having a four bar and four pivot mechanical linkage. Particularly to a knife utilizing the motion of the four bar mechanical linkage to rearrange the components of the knife into the open and closed positions.

2. Description of Prior Art

An advantage of folding knives is that the sheath protecting the blade is attached to the blade and cannot be lost. A disadvantage of folding knives in general is the possibility of catching a finger between the blade and handle as the blade folds sharp side first into the handle with a scissoring motion as the knife closes. Secondly, all the loads encountered during use of a folding knife bear on the single main pivot and require that the single pivot be of significant strength to prevent the knife from breaking.

3. Summary of the Invention

The present invention is a knife with a parallelogram-like mechanical linkage having four bars and four pivots. Extending from one bar of the linkage is a blade and extending from blade to the sheath are the forward half and rear half of the handle and rotate in the same direction with each other to sheath and un-sheath the blade. When the knife is open the bars of the parallelogram that are the handle pieces align and become the handle with the sheath being hidden inside the handle. When closing the knife the sheath covers the blade in a non scissoring motion as the handle sections rotate in the same direction until the sheath fully covers the blade.

The four bar four pivot mechanical linkage is also used as a knife in the anti-parallel format where the bars linking the blade to the handle rotate in opposite directions as they carry the blade in and out of the handle, the bar having the blade being opposite to the bar having the handle. The blade of the anti-parallel knife is pointed in the same direction inside the handle as it is outside the handle when open. Additionally the blade pivots in and out of the handle from a virtual pivot point created by the anti-parallel four bar four pivot linkage. The blade pivots in one direction, then back in the other direction as it enters the handle without the scissoring motion associated with folding knives in general.

The mechanical structure of the four bar knife, in both parallel and anti-parallel formats, offers safety because the blade cannot fold onto the users hand during closing. Stability of the blade is increased by having two longitudinally oriented pivot points on the tang of the blade thus reducing the structural requirements of the pivot mechanisms.

An object of this invention is a self sheathing knife that has the safety feature of not allowing the users hand to be caught between the blade and the handle either during use or during closing.

Another object of this invention is a knife that can be easily mass produced by existing common fabrication methods.

These and other objects of the present invention will become apparent to those skilled in the art upon reading the accompanying description, drawings, and claims put forth herein.

DETAILED DESCRIPTION OF THE INVENTION

In the following description and accompanying drawings the working properties and details of the invention are set forth in order to provide one skilled in the art to utilize the working properties of the invention without these details. The details and materials are used as examples and are not intended to limit the scope of the invention.

Figure 1:
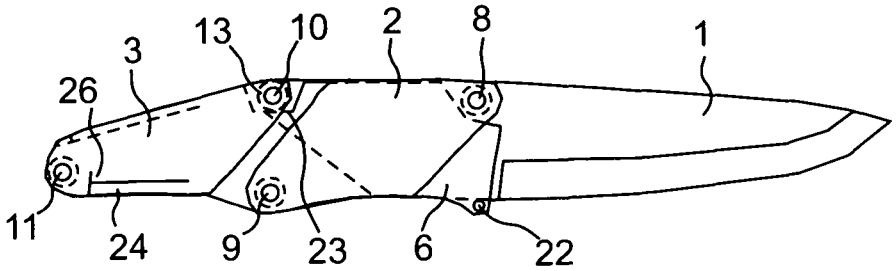
FIG. 1 is a side section view of a four bar parallel linkage knife in the open position.
Figure 1A:
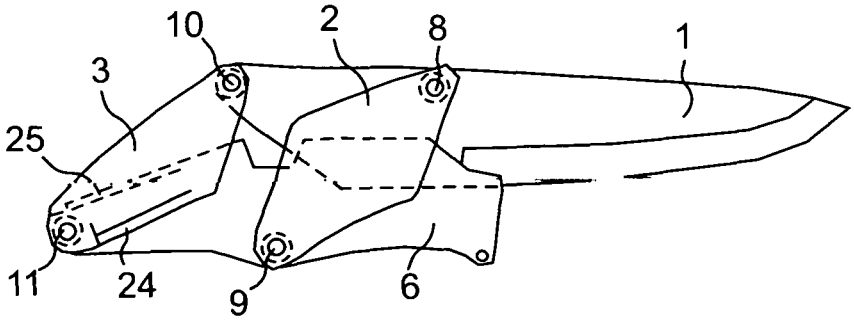
FIG. 1A shows the knife in the two thirds open position.
Figure 1B:
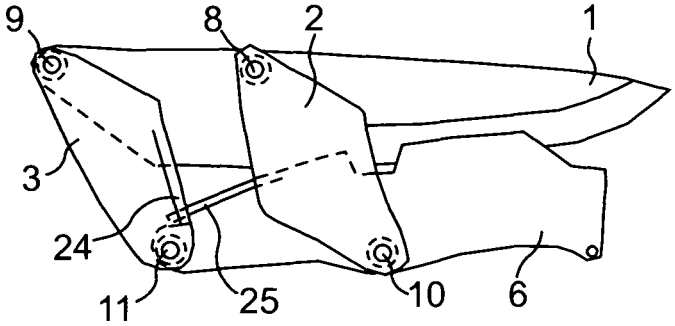
FIG. 1B shows the knife in the one third open position.
Figure 1C:
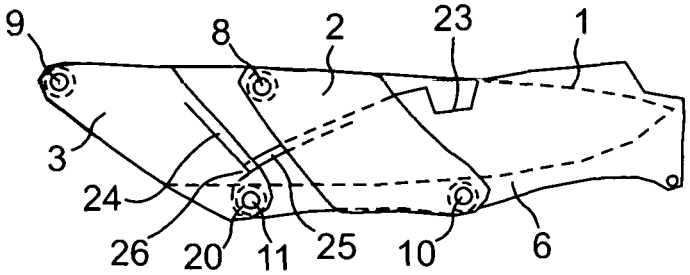
FIG. 1C shows the knife in the closed position.

FIG. 1 depicts a side section view of a parallel four bar linkage knife in the open position and with the sheath component 4 hidden behind the handle components 2 and 3. The sheath 6 component 23 is also contacting bushing 13 whereby said contact provides a stop for the parallelogram motion of the knife when opening. The handle components 2 and 3 are aligned together being the handle of the knife when the knife is open. In FIG. 1 pin 22 is shown in contact with blade 1 thereby providing an additional stop for the parallelogram motion at the open position. FIG. 1A shows said knife in a one third closed position with handle pieces 2 and 3 both rotated counterclockwise and the sheath component 6 partially covering the blade 1. FIG. 1B depicts said knife in a two thirds closed position with handle pieces 2 and 3 both rotated further counterclockwise and the sheath component 6 mostly covering the blade 1. FIG. 1C depicts said knife fully closed with a bushing 20 shown contacting the blade 1 thereby providing a stop for the parallelogram motion when the knife is closed.

Figure 2:
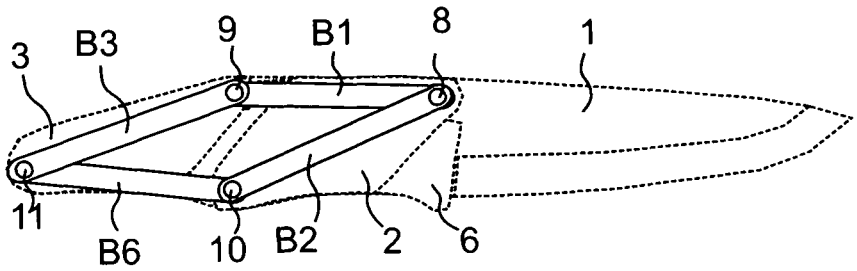
FIG. 2 shows a parallel four bar linkage overlaying the FIG. 1 knife.
Figure 2A:
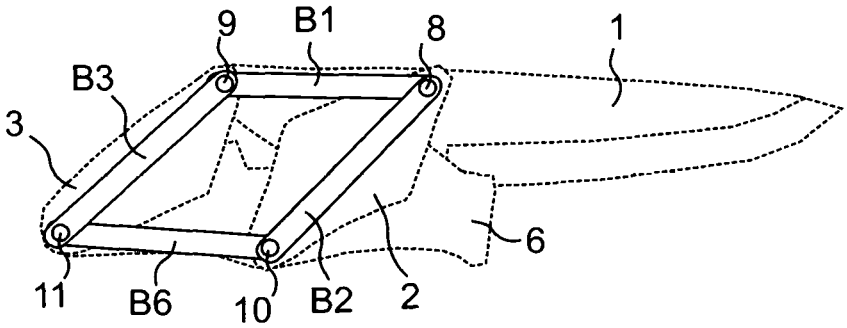
FIG. 2A shows the four bar linkage overlaying the FIG. 1A knife.
Figure 2B:
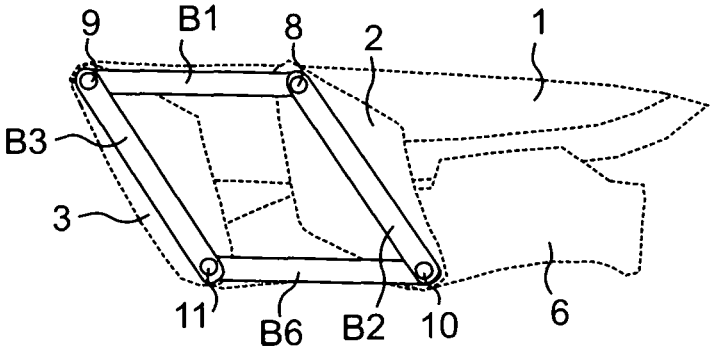
FIG. 2B shows the four bar linkage overlaying the FIG. 1B knife.
Figure 2C:
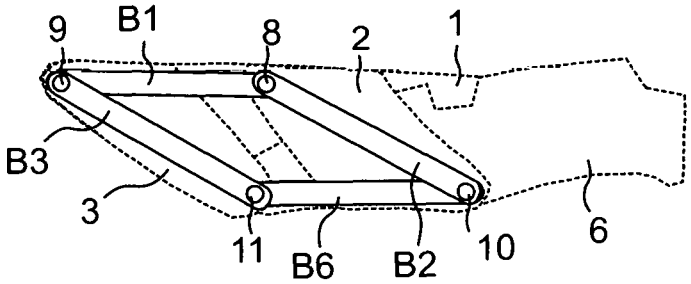
FIG. 2C shows the four bar linkage overlaying the FIG. 1C knife.

FIG. 2 depicts a parallel four bar linkage overlaying the knife of the present invention whereby each bar can be seen associated with a corresponding component of the knife. The blade 1 is part of bar B1. Handle piece 2 is part of bar B2. Handle piece 3 is part of bar B3, and the blade sheath 6 is incorporated into bar B6. FIG. 2A depicts the position of the parallelogram bars one third closed. FIG. 2B depicts the parallelogram position of the four bar knife two thirds closed. FIG. 2C depicts the parallelogram structure of the knife in the closed position.

Figure 3:
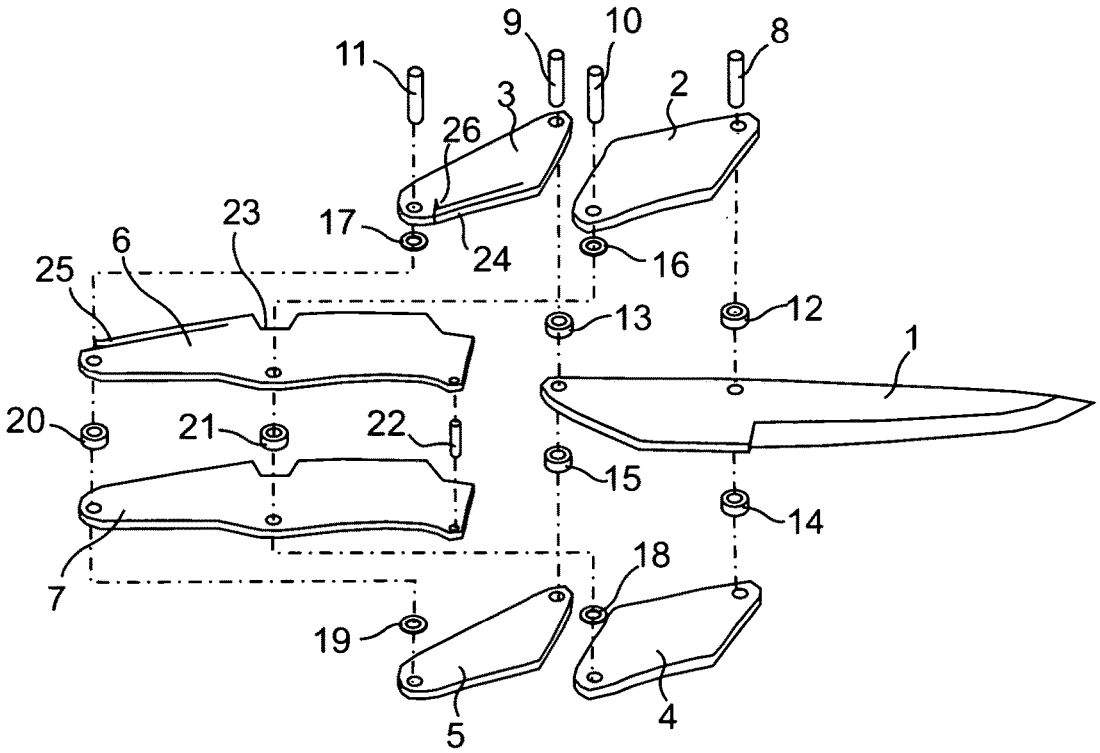
FIG. 3 is an exploded view of a parallel four bar linkage knife.
Figure 3A:
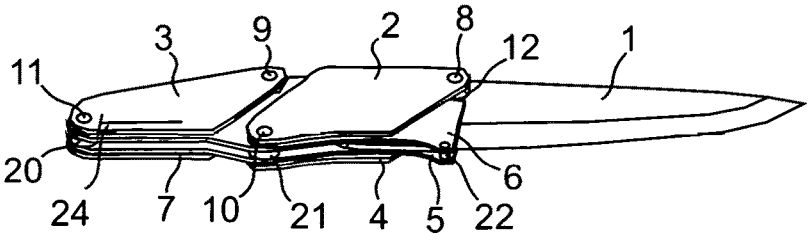
FIG. 3A shows the FIG. 3 knife assembled.

FIG. 3 depicts the detailed assembly of the present invention. A blade 1 connecting to handle components 2 and 4 by pin 8. The blade 1 also connecting to handle components 3 and 5 by pin 9. Pin 8 and pin 9 moving freely in the blade 1 and attached securely in the handle components 2 and 4, and 3 and 5 respectively. Bushings 12, 13, 14, and 15 provide sufficient clearance between the blade 1 and the handle components 2, 3, 6, and 7 for sheath components 6 and 7 to move between without interference. Handle components 2 and 4 are connecting to sheath components 6 and 7 by pin 10. Pin 10 is attached securely to handle components 2 and 7 but moves freely in sheath components 6 and 7. Handle components 3 and 5 are connected also to the sheath components 6 and 7 by pin 11. Pin 11 is securely attached to handle pieces 3 and 5 and moving freely in sheath pieces 6 and 7. Preventing interference between handle pieces 2 and 3, and the sheath piece 6 are washers 16 and 17 respectively. Preventing interference between handle pieces 4 and 5, and the sheath piece 7 are washers 18 and 19 respectively. Bushings 21 and 22 between sheath pieces 6 and 7 are of sufficient thickness allow motion between the blade 1 and the sheath pieces 6 and 7 without interference. The pin 22 is anchored securely in the sheath pieces 6 and 7. FIG. 3A depicts the knife complete.

Figure 4:
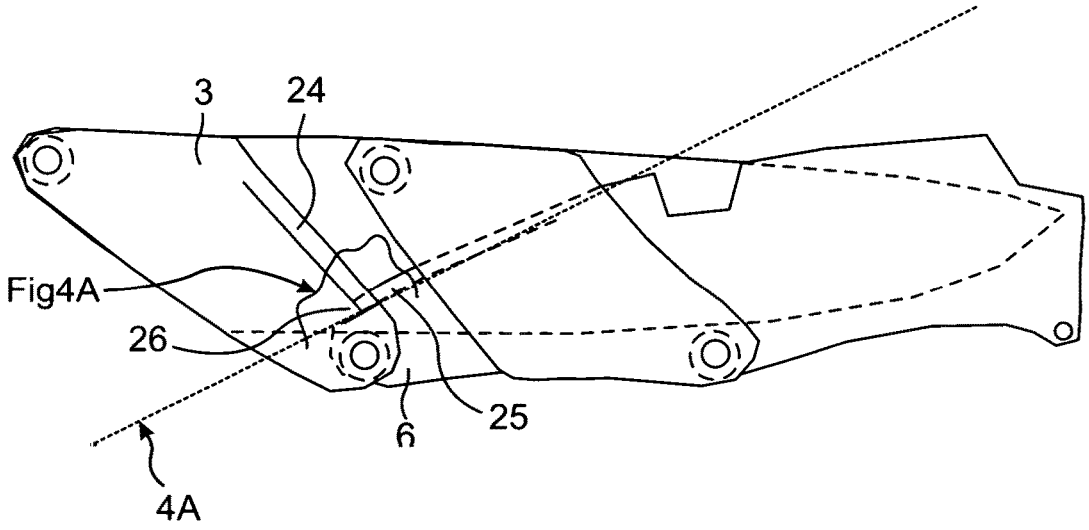
FIG. 4 shows the parallel four bar linkage knife closed with a section line indicating the location of the FIG. 4A detail.
Figure 4A:
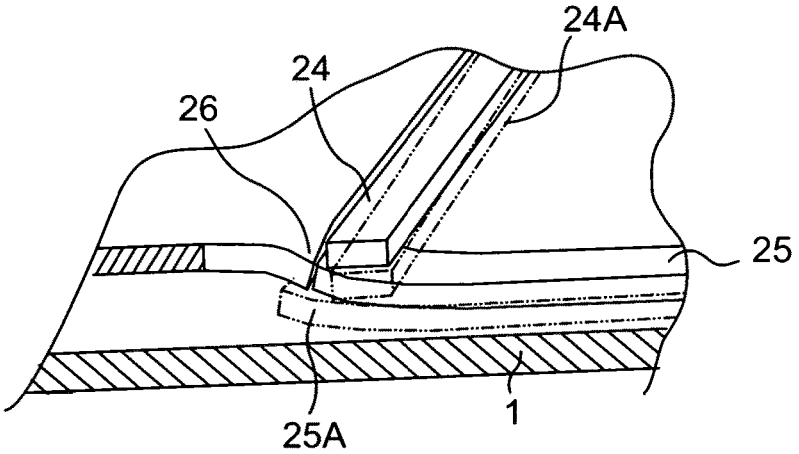
FIG. 4A shows the detail of a latch mechanism.

FIG. 4 is the same as FIG. 1C but with a section line 4A and section area referring to FIG. 4A. FIG. 4A illustrates a latching mechanism of claim 6 whereby the flexible appendage 25 of sheath 6 is abutting the deflected corner 26 of handle piece 3 and thereby cannot move past feature 26. Flexible appendage 24, part of handle piece 3, is depressed to alternate position 24A by the users thumb, FIG. 5. Appendage 24 in turn pressing appendage 25 bellow the level of the corner 26 and allowing 25 to move past corner 26 to position 25A and beyond thus unlocking the knife from a closed position. When latching appendage is moving from 25A to the position shown in solid lines, 25, the appendage flexes down as it slides past corner 26 then flexing immediately up and abutting the corner 26 thereby locking the knife closed.

Figures 5, 5A, 5B, 5C:
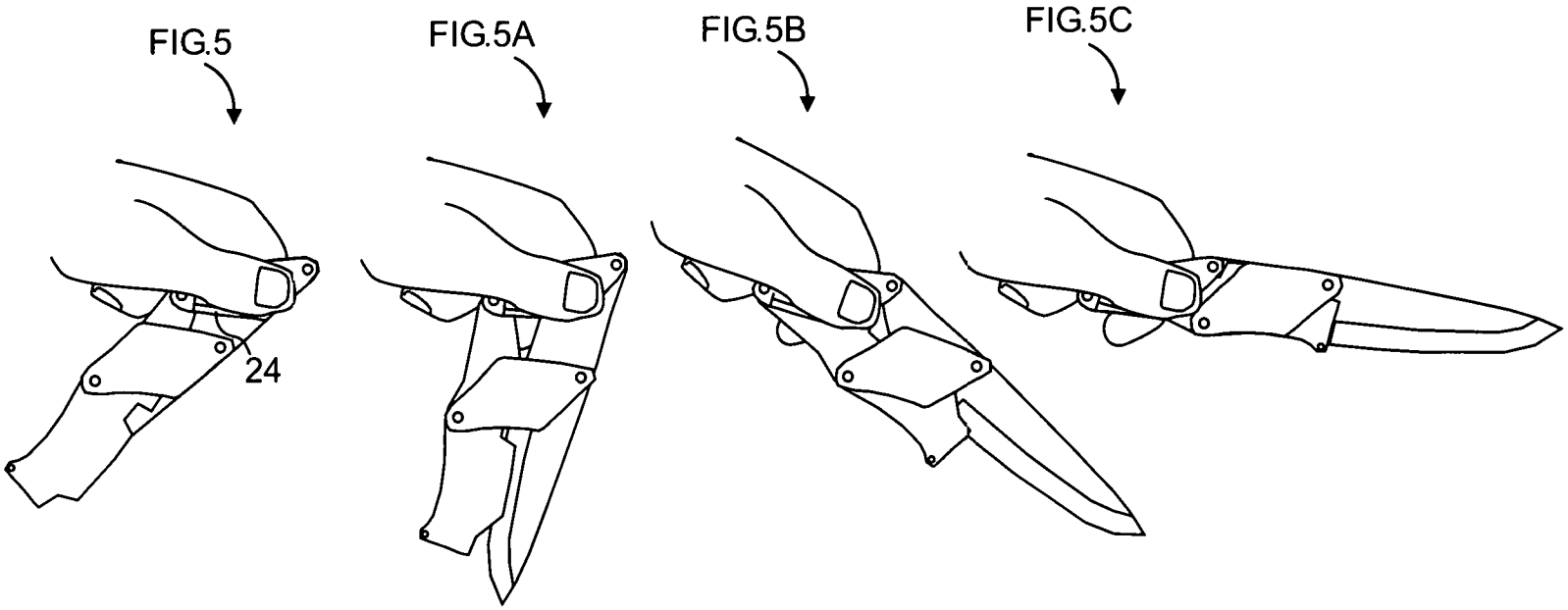
FIG. 5 shows how the closed knife is held in order to open the knife.
FIG. 5A shows the knife held one third open.
FIG. 5B shows the knife held two thirds open.
FIG. 5C shows the knife held fully open.

FIG. 5 depicts a method of opening the invented knife by holding the invention by the back handle piece between the thumb and fore finger. Then squeezing appendage 24 thereby releasing the latch and allowing the knife to swing through positions FIG. 5A and FIG. 5B and into the open position FIG. 5C. Swinging the knife back through position FIG. 5B to FIG. 5A then to position FIG. 5 closes the knife engaging the latch of FIG. 4A locking the knife closed.

Figure 6:
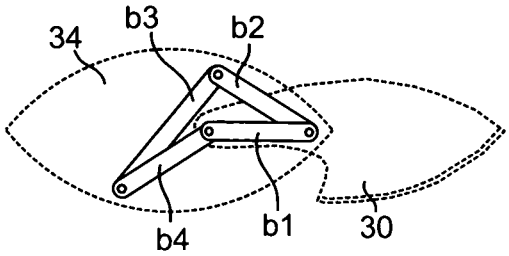
FIG. 6 shows an anti-parallel four bar linkage overlaying an anti-parallel linkage knife fully open.
Figure 6A:
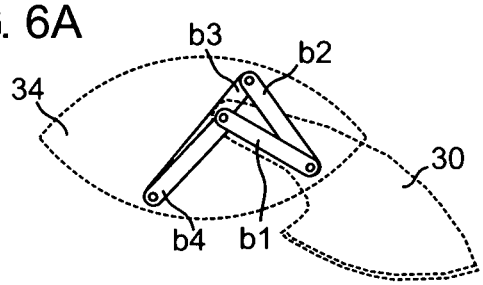
FIG. 6A shows the linkage overlaying the knife three quarters open.
Figure 6B:
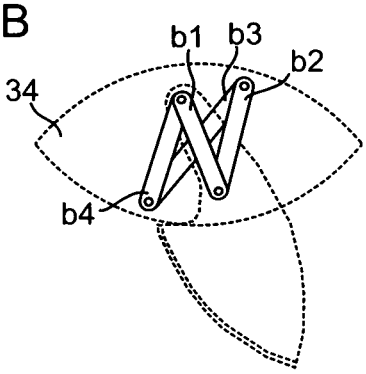
FIG. 6B shows the linkage overlaying the knife half open.
Figure 6C:
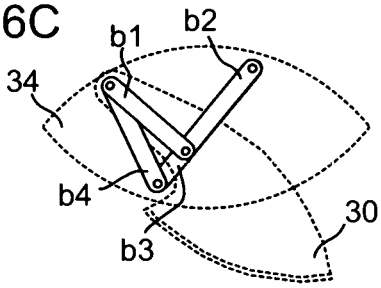
FIG. 6C shows the linkage overlaying the knife one quarter open.
Figure 6D:
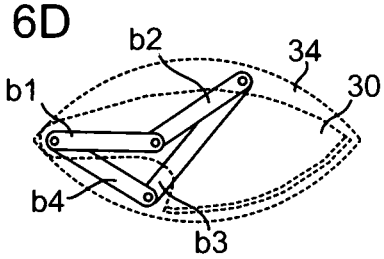
FIG. 6D shows the linkage overlaying the knife fully closed.

FIG. 6 depicts a four bar anti-parallel linkage numbered with the prefix b and overlaying an outline of the knife handle 34 and blade 30. Bars b2 and b4 are the links that connect the bar b1, which carries the blade, to bar b3 which is the handle. The FIG. 6 series of figures shows a motion of a four bar anti-parallel linkage that moves a blade 30 in and out of a handle/sheath 33. FIG. 6A shows a one quarter closed position. FIG. 6B the knife is half closed and the bar b1, that carries the blade 30, and the bar b3, that carries the handle, are in the anti-parallel position. FIG. 6C shows the knife three quarters closed. FIG. 6D the knife is closed with the blade 30 fully within the handle 33.

Figure 7:
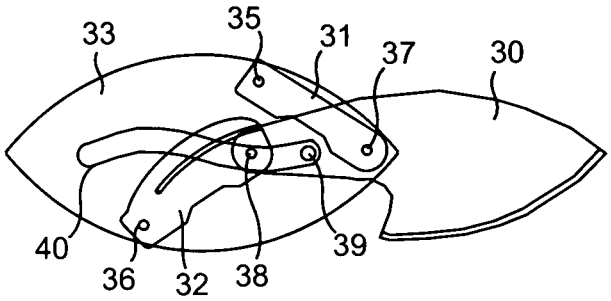
FIG. 7 is a side section view of an anti-parallel four bar linkage knife open.
Figure 7A:
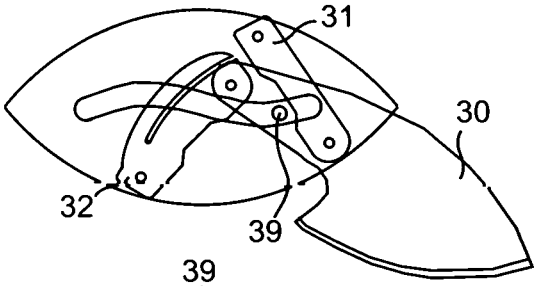
FIG. 7A shows the knife three quarters open.
Figure 7B:
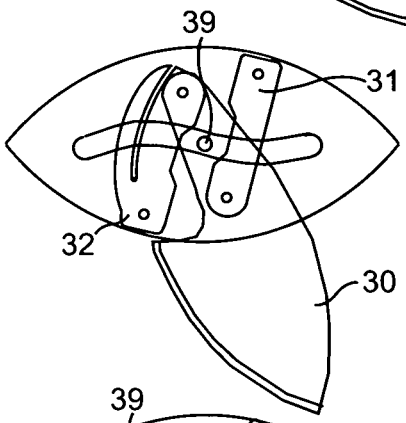
FIG. 7B shows the knife half open.
Figure 7C:
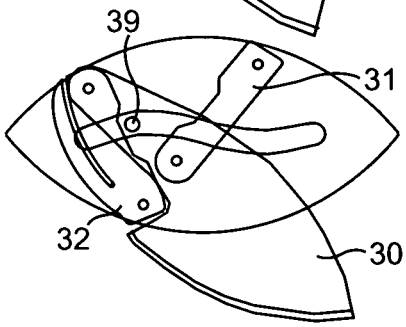
FIG. 7C shows the knife one quarter open.

FIG. 7 is a transparent side view of an anti-parallel four bar knife in a five position sequence from open to closed. The sequence depicts the positions of the blade 30, relative to the handle 33 as carried by the two links 31 and 32. A post 39 is shown at the end of opening 40 whereby the ends of opening 40 limit the travel of post 39. Post 39 is attached to the blade 30 and is used to push the knife open and closed. FIG. 7A shows the knife beginning to close, FIG. 7B the knife is half closed, and FIG. 7 three quarters closed, and FIG. 7D fully closed.

Figure 8:
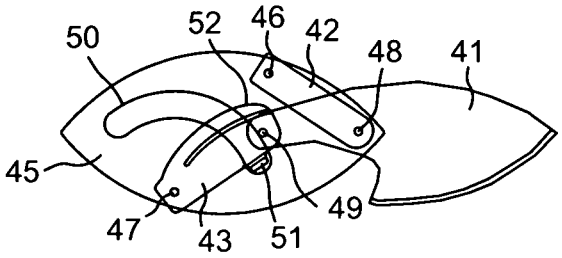
FIG. 8 is a side section view of an anti-parallel four bar linkage knife in the open position with an alternate opening tab.
Figure 8A:
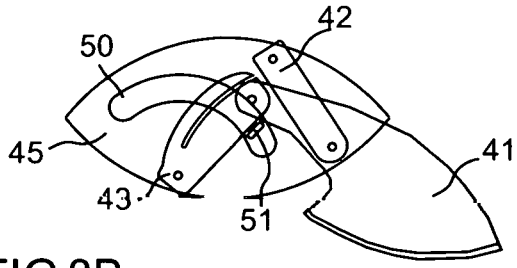
FIG. 8A shows the knife three quarters open.
Figure 8B:
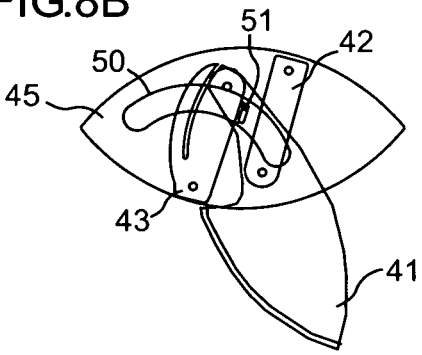
FIG. 8B shows the knife half open.
Figure 8E:
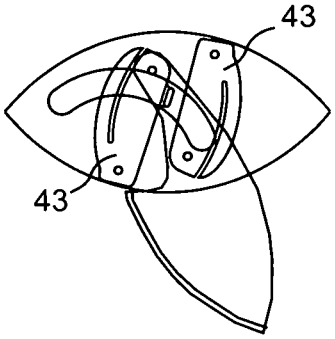
FIG. 8E shows the knife half open with an additional latch.
Figure 8C:
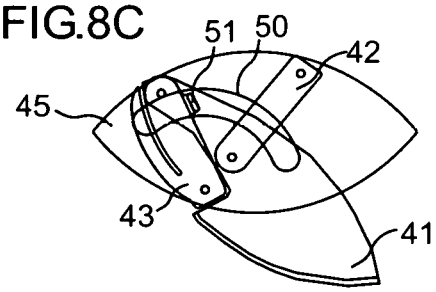
FIG. 8C shows the knife one quarter open.
Figure 8D:
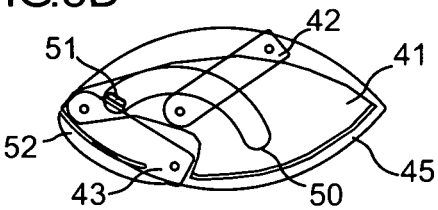
FIG. 8D shows the knife closed.

FIG. 8 is view of an anti-parallel four bar knife and differs from the knife of FIG. 7 in the method of operation wherein the lever 51, used to open and close the FIG. 8 knife, is an appendage of linking bar 43. The lever 51 protrudes through the opening 50 in handle piece 45. Lever 51 is at the end of the opening 50 wherein the length of opening 50 limits the range of motion of link 43 thereby stopping the four bar linkage in open and closed positions. FIG. 8A the knife is one quarter closed. FIG. 8B the knife is half closed. FIG. 8C the knife is three quarters closed, and FIG. 8D the knife is fully closed. FIG. 8E depicts the knife half open but with link 42, FIG. 8, replaced with link 43 thereby functioning as an additional latch for the open position and functioning in the same method of the latch depicted in FIG. 9A but for the open position.

Figure 7D:
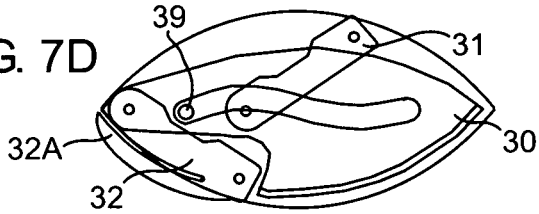
FIG. 7D shows the knife closed.
Figure 9:
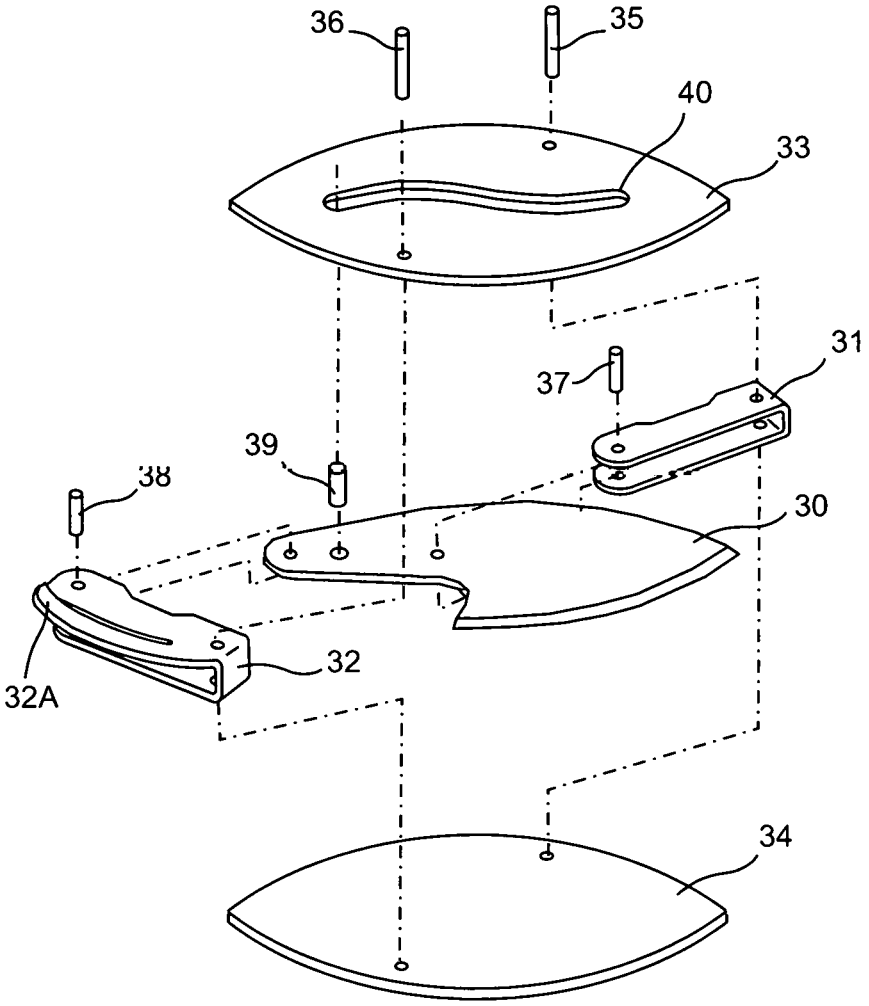
FIG. 9 is an exploded view the knife seen in FIG. 7D.
Figure 9A:
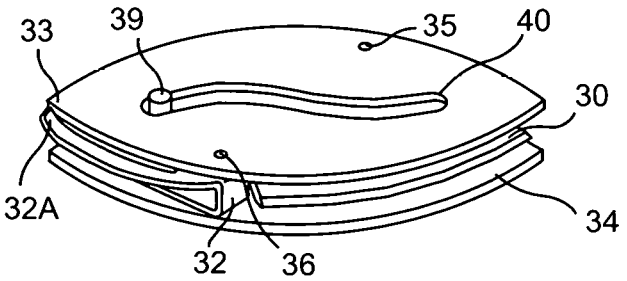
FIG. 9A shows the knife assembled.

FIG. 9 is the exploded view of the knife of FIG. 7D. Pin 36 passes through link 32 whereby link 32 pivots freely on pin 36 and pin 36 is connected to handle pieces 33 and 34. Pin 35 passes through link 31 whereby link 31 pivots freely on pin 35 which is connected to handle pieces 33 and 34. The blade 30 is attached to link 31 by pin 37. Pin 37 is attached to link 31 and pivots freely in the blade 30. The blade is also attached to link 32 by pin 38 whereby pin 38 is attached securely in link 38 and pivots freely in the blade 30. Post 39 is attached securely in the blade 30 and protrudes through opening 40 and is a means by which the knife can be opened and closed. Flexible appendage 32A is a means by which the knife can be latched. FIG. 9A depicts the complete knife in the closed position with appendage 32A contacting the corner of handle piece 33. Pressing appendage 32A down past the corner of handle 33 releases the latch and allows the knife to open.

Figure 10:
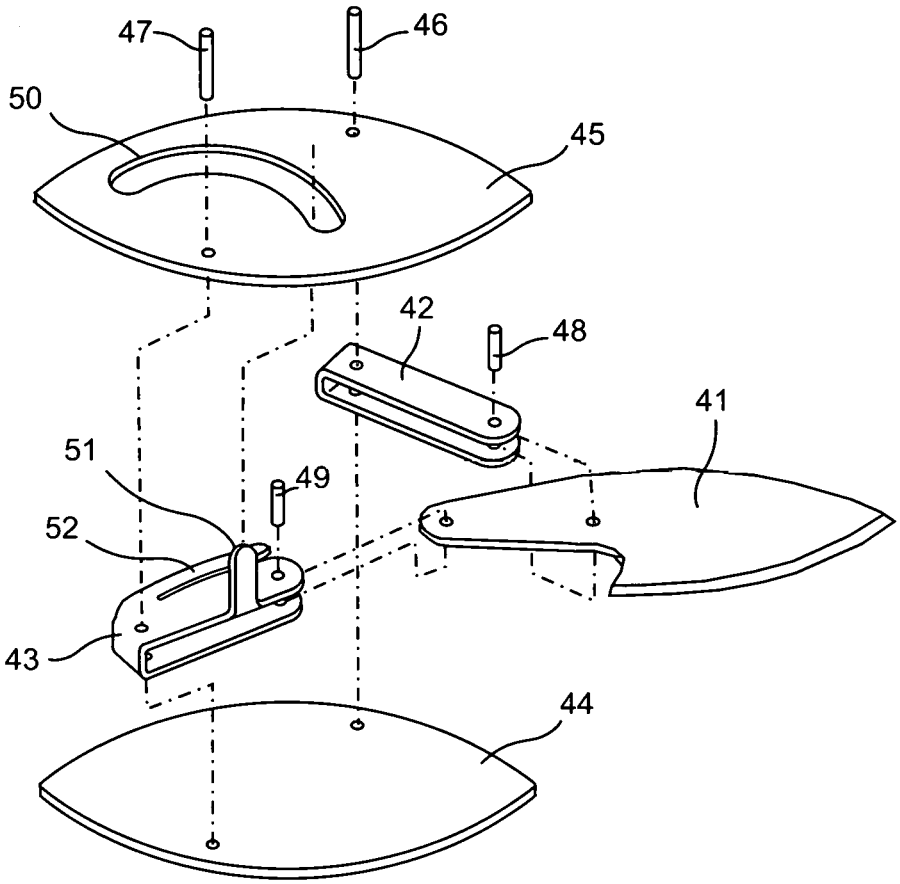
FIG. 10 is an exploded view of the knife seen in FIG. 8.
Figure 10A:
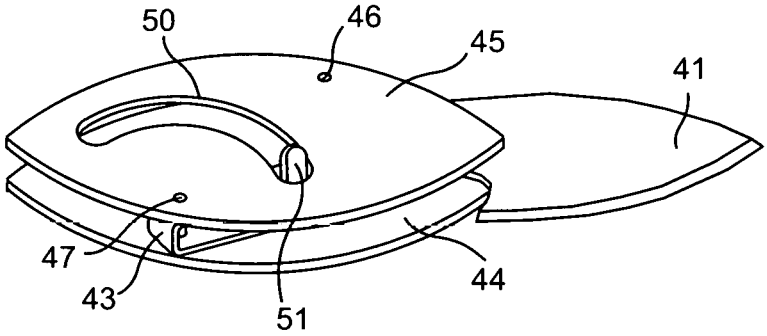
FIG. 10A shows the knife assembled.

FIG. 10 is an exploded view of the knife in FIG. 8. The significant difference shown between the knife of FIG. 9 and the knife of FIG. 10 is the method operation. The knife of FIG. 9 is opened and closed by post 39, FIG. 9, which is attached to the bar of the four bar anti-parallel linkage that has the blade, whereas the knife of FIG. 10 is opened and closed by appendage 51 protruding through opening 50 from link 43. Link 43 being a linking bar of a four bar anti-parallel linkage. The construction is the same as that of FIG. 9. Pins 46 and 47 attached securely in handle pieces 44 and 45, and pivoting freely in links 42 and 43. Pins 48 and 49 pivoting freely in the blade 41 and attached securely in links 42 and 43 respectively.

Thus it will be appreciated by those skilled in the art that the present invention is not restricted to the preferred embodiments described with reference to the drawings, and that variations may be made therein without departing from the scope of the present invention as defined by the appended claims and equivalents thereof.

What is claimed is:

1. A knife comprising:

a four bar four pivot anti-parallel mechanical linkage, wherein the four bar four pivot anti-parallelogram linkage includes four bars, including:

a first bar with a blade extending from one end thereof, wherein there is no relative movement between the first bar and the blade;

a second bar, opposite the first bar, with a handle;

a third bar linking the first and second bars, wherein the third bar has a pivot that is disposed at an end of the first bar and has no translating movement with respect to said end of the first bar; and a fourth bar linking the first and second bars, wherein the four bars form an anti-parallelogram structure, and wherein, an anti-parallelogram motion occurs when the third and fourth bars rotate together in opposite directions thereby carrying the blade into and out of the handle to open and closed positions.

2. The knife according to claim 1 further comprising a latch for latching said knife in a fixed position.

3. The knife according to claim 1 further comprising a lever for activating the anti-parallelogram motion.

4. The knife according to claim 1 wherein, the second bar is comprised of a first handle side and a second handle side spaced to accept the blade between the first and second handle sides.

* * * * *